US006193502B1

(12) United States Patent
Sudarev et al.

(10) Patent No.: US 6,193,502 B1
(45) Date of Patent: Feb. 27, 2001

(54) FUEL COMBUSTION DEVICE AND METHOD

(75) Inventors: Anatolij Vladimirovic Sudarev; Jevgenij Dimitrijevic Vinogradov; Jurij Ivanovic Zacharov, all of Sankt Petersburg (RU); Stanislav Vesely; Gustav Poslusny, both of Brno (CZ); Karl Peters, Mettmann (DE); Karl-Heinz Scholz; Erik Zizow, both of Essen (DE)

(73) Assignee: Ruhrgas Aktiengesellschaft (DE)

( * ) Notice: Subject to any disclaimer, the term of this patent is extended or adjusted under 35 U.S.C. 154(b) by 0 days.

(21) Appl. No.: 09/367,205

(22) PCT Filed: Jan. 24, 1998

(86) PCT No.: PCT/EP98/00398

§ 371 Date: Nov. 22, 1999

§ 102(e) Date: Nov. 22, 1999

(87) PCT Pub. No.: WO98/35184

PCT Pub. Date: Aug. 13, 1998

(30) Foreign Application Priority Data

Feb. 8, 1997 (DE) ..... 197 04 802

(51) Int. Cl.[7] ..... F23D 14/22

(52) U.S. Cl. ..... 431/351; 431/8; 431/10; 431/353; 431/190; 239/132; 239/427.3; 60/758; 60/760

(58) Field of Search ..... 431/8, 9, 10, 181, 431/187, 188, 190, 115, 350, 351, 352, 353; 60/752, 758, 759, 760; 239/132, 132.1, 132.3, 132.5, 418, 427, 427.3

(56) References Cited

U.S. PATENT DOCUMENTS

| | | | | |
|---|---|---|---|---|
| 2,974,485 | * | 3/1961 | Schiefer | 60/758 |
| 3,643,430 | * | 2/1972 | Emory, Jr. et al. | 60/758 |
| 3,751,911 | * | 8/1973 | De Tartaglia | 60/758 |
| 3,831,854 | * | 8/1974 | Sato et al. | 431/352 |
| 4,054,028 | * | 10/1977 | Kawaguchi | 431/10 |
| 4,301,657 | * | 11/1981 | Penny | 60/758 |
| 5,984,662 | * | 11/1999 | Barudi et al. | 431/8 |

* cited by examiner

*Primary Examiner*—Ira S. Lazarus
*Assistant Examiner*—Josiah C. Cocks
(74) *Attorney, Agent, or Firm*—Blakely Sokoloff Taylor & Zafman

(57) ABSTRACT

The fuel is fed centrally into a fire tube (3), where it is mixed with combustion air in a combustion zone. The air exits through first and second air line nozzles (4 or 5) which are arranged in two directly adjoining rows (6, 7) and inclined in the direction of counterflow at an angle of 60° to the axis of the fire tube. The distance (x) between the fuel nozzle (9) and the openings of the first air line nozzles (4) is 0.70 times the diameter of the fire tube. In addition, the second air line nozzles (5) extend into the fire tube by a distance (y) which is 0.17 times the diameter of the fire tube. The total cross-section of the second air line nozzles (5) is 0.6 times that of the first air line nozzles (4). A highly turbulent toroidal eddy forms inside the fire tube (3) which generates a very homogeneous mixture across the cross-section of said fire tube (3). This results in lower $NO_x$ values and even temperature distribution already inside the fire tube.

18 Claims, 2 Drawing Sheets

1
2
3
4
5
6
7
8
9
y
d
x
φ
φ
A 1
2
3
4
4"
5
9

FUEL COMBUSTION DEVICE AND METHOD

BACKGROUND OF THE INVENTION

Field of the Invention

The invention relates to a burner for fuels suitable for spraying, in particular gaseous fuels, having a substantially cylindrical fire tube, a fire tube cover arranged on the upstream end of the fire tube, a fuel nozzle terminating centrally in the fire tube cover and means to feed the combustion air into the fire tube.

Such designs are used above all as standard burners for gas turbines.

Furthermore, the invention relates to a method for burning the fuel suitable for spraying, in particular gaseous fuel, which is fed centrally into a combustion zone where it is mixed with combustion air.

A major objective of modern combustion technology is to produce low-pollutant waste gases. In addition to complete burnout to avoid carbon monoxide, low $NO_x$ values are a particular objective.

Normally, a combustion zone is formed at the burner head, into which combustion zone the combustion air is blown through corresponding openings in the fire tube cover and in the fire tube, thus cooling the fire tube material. Further combustion air is fed in through scale-like openings which are distributed along the entire fire tube.

It has been found that such devices and methods can be improved on. The object of the present invention was therefore to achieve even temperature distribution in the fire tube and thus a reduction in the amount of pollutants produced.

This object is achieved by the device of the aforementioned type in that the means to feed the combustion air into the fire tube exhibit a plurality of first and second air line nozzles, that the first and second air line nozzles are inclined in the direction of counterflow at an angle to the axis of the fire tube, that the first air line nozzles end at the fire tube whilst the second air line nozzles extend into the fire tube and that a first air line nozzle is assigned to each second air line nozzle and arranged upstream directly adjacent thereto.

The method of the aforementioned type to achieve the desired objective is characterised in that the combustion air is blown into the combustion zone in such a manner that a highly turbulent toroidal eddy forms in a plane perpendicular to the direction of flow of the combustion zone, the direction of rotation of said turbulent toroidal eddy inside being against the direction of flow of the combustion zone.

SUMMARY OF THE INVENTION

Major embodiments of the present invention result from the dependent claims.

The toroidal eddy or eddy ring generated at the burner head generates a very intensive turbulent circulation and thus a good mixing of fuel and air. Due to the higher degree of homogeneity of the fuel-air mixture, the number of local areas, which exhibit stoichiometric or near-stoichiometric mixture concentrations and, due to their extreme temperatures, are the main source of $NO_x$ emissions, is reduced.

The combustion chamber of the invention is a so-called diffusion chamber in which the speed of the combustion process is governed by the speed of the fuel-air swirling and not by the speed of the chemical reactions. Therefore, the higher degree of mixing caused by the highly turbulent toroidal eddy in the upstream area of the fire tube leads to a shorter residence period of the combustion products in the high-temperature range, which reduces the amount of $NO_x$ emissions generated.

Furthermore, the invention leads to an increased penetration of the fuel flow by the air streams exiting through the first and second air line nozzles, said air streams preferably forming a major part of the entire combustion air. The second air line nozzles extending into the inside of the fire tube contribute particularly to the formation of the eddy. This achieves an even distribution of air across the fire tube cross-section and in this manner reduces the unevennesses of the gas temperature field in the combustion zone. This is particularly of substantial importance when the combustion chamber is used as the turbine combustion chamber, which is in fact one of its main fields of application. Temperature peaks constitute a considerable load for turbine blades and shorten their service life.

The air streams exiting through the second air line nozzle penetrates deep into the hot gas flow. It therefore cools the high-temperature range up to the axis of the fire tube.

Although the second air line nozzles extend into the combustion zone, the temperature loading is controlled in that an upstream first air line nozzle and preferably also a downstream third air line nozzle is assigned to and arranged directly adjacent to each second air line nozzle. The second air line nozzles are therefore cooled by the air exiting through the first air line nozzles and optionally through the third air line nozzles. The number of similar first and third air line nozzles can be increased even further by similar fourth air line nozzles which, viewed in the circumferential direction, are arranged between adjacent second air line nozzles. It has been found that the cross-section distribution between the two types of air line nozzles substantially increases the evenness of temperature distribution at the combustion chamber outlet.

In addition to the arrangement of the air line nozzles, a critical value for formation of an optimal highly turbulent toroidal eddy is the angle of incline of the air line nozzles to the axis of the fire tube. An angle of incline of 55 to 60° has proved to be very favourable. Furthermore, the axial distance between the first air line nozzles and the fuel nozzle is also of critical importance. It has been found that this distance depends on the diameter of the fire tube and is preferably approx. 0.70 times to 0.85 times the diameter of the fire tube.

The invention not only permits more intensive swirling of the fuel-air mixture and thus a more intensive combustion process but also at the same time permits a high stabilisation of the pilot flame in all load ranges.

Apart from the arrangement of the air line nozzles, the distance of the air line nozzles to the axis of the fire tube is of critical importance for a favourable air distribution across the fire tube cross-section and thus for a very even gas temperature field at the combustion chamber outlet. These values also depend on the diameter of the fire tube. Whilst the discharge openings of the first and optionally the third and fourth air line nozzles are flush with the fire tube, the discharge openings of the second air line nozzles should be at a distance to the fire tube and said distance should preferably be approx. 0.15 times to 0.18 times the fire tube diameter. The ratio between the total cross-sections of the two types of air line nozzles is also critical in this connection. It has proved to be particularly advantageous for the total cross-section of the second air line nozzles to be approx. 0.6 to 0.7 times the total cross-section of the first and optionally the third and fourth air line nozzles.

Additional combustion air can be supplied in the area of the fire tube cover and thereby cool said fire tube cover. Furthermore, it is possible to feed in combustion air through openings in the fire tube wall downstream of the air line nozzles. This measure proves to be advantageous for reducing the generation of carbon monoxide.

BRIEF DESCRIPTION OF THE DRAWINGS

The invention is explained in more detail in the following using a preferred embodiment together with the attached drawing: The drawing shows in.

DETAILED DESCRIPTION OF THE INVENTION

Figure 1:
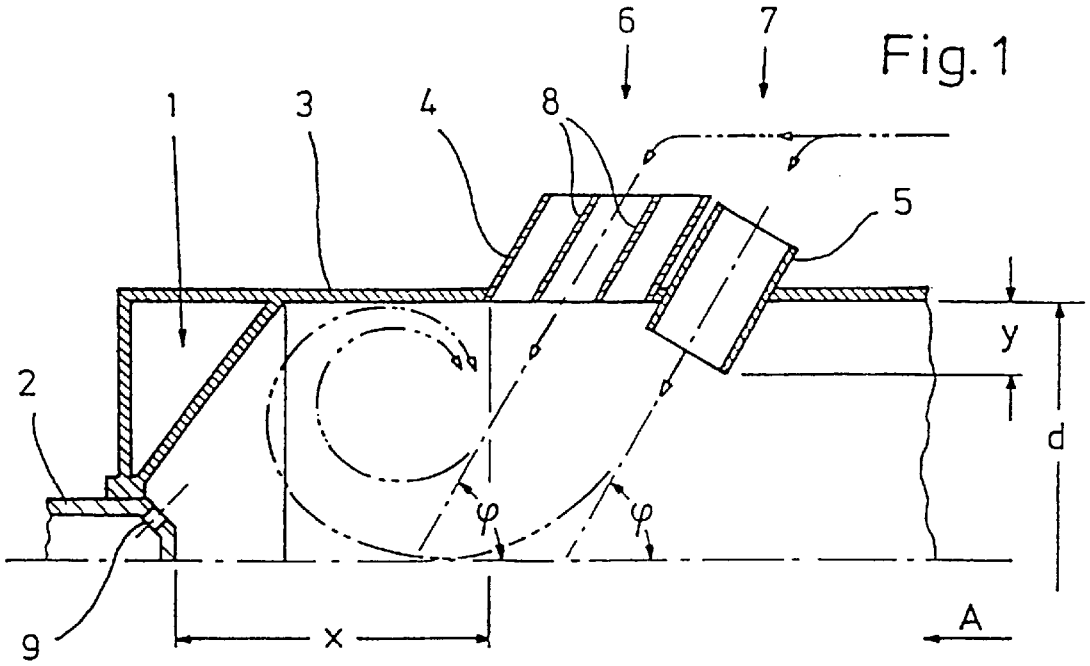
FIG. 1 a schematic of an axial partial section through a burner according to a first embodiment.
Figure 2:
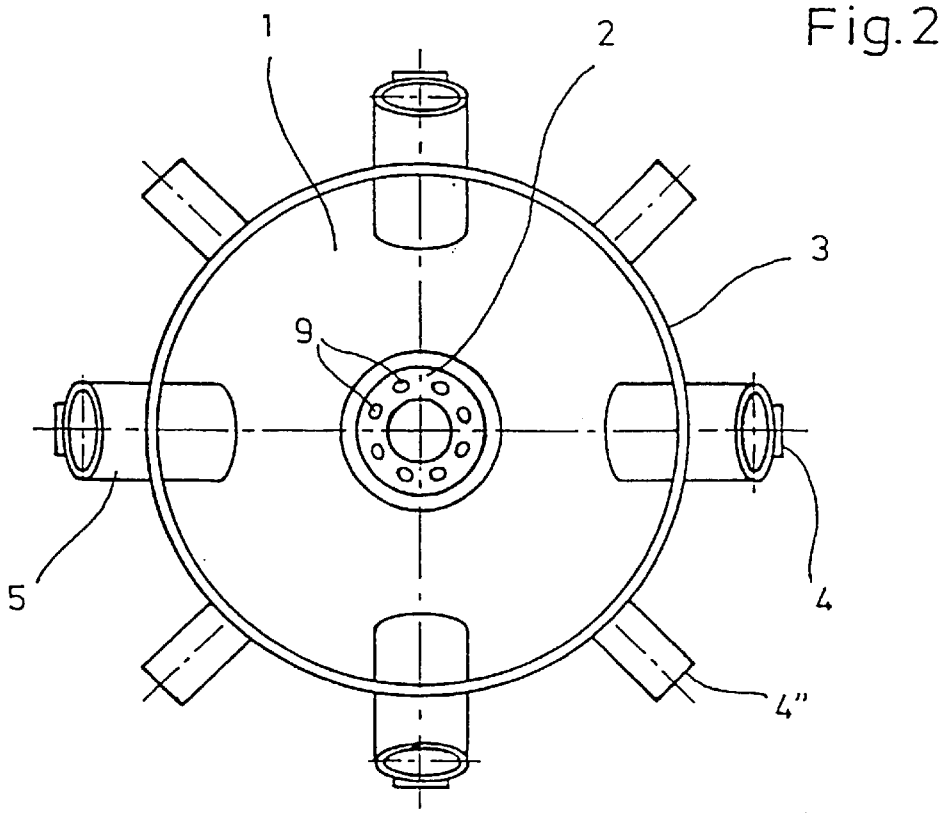
FIG. 2 a view in the direction of arrow A in FIG. 1.

The burner according to FIGS. 1 and 2 exhibits a fire tube cover 1, in the center of which a fuel nozzle 2 terminates which is connected to a gas lance. A cylindrical fire tube 3, whose diameter is given as d, adjoins the fire tube cover 1.

A plurality of first and second air line nozzles 4 and 5 is arranged on the fire tube 3. The first air line nozzles 4 form an upstream first row 6 and the second air line nozzles 5 form a downstream row 7 immediately adjacent to the first air line nozzles 4. All air line nozzles 4 and 5 are inclined in the direction of counterflow to the axis of the fire tube 3, by a common angle $\phi$, which in the case of the embodiment is 60°.

The combustion air is mainly fed into the combustion zone through the air line nozzles 4 and 5 in such a manner that it forms a highly turbulent toroidal eddy or eddy ring, which is indicated in FIG. 1 by a broken line. The intensive mixing leads to a homogeneous distribution of the fuel in the combustion air which leads to reduced $NO_x$ formation due to the reduced residence period in the combustion zone, together with a more even temperature distribution already in the fire tube.

The distance x between the air line nozzles 4 of the first row 6 and the fuel nozzle 2 is 0.70 times the diameter of the fire tube d. This contributes towards stabilisation of the eddy ring and furthermore guarantees a stable ignition behaviour throughout the entire performance range.

As can be clearly seen from FIG. 1, the openings of the first air line nozzles 4 of the first row 6 are flush with the fire tube whilst the second air line nozzles 5 of the second row 7 extend into the fire tube, by a distance y which is 0.17 times the fire tube diameter d. The air streams exiting through the second air line nozzles 5 therefore penetrate into the combustion zone up to the axis of the fire tube 3, take up the central area of the combustion zone and then in the course of their movement upstream form together with the air streams exiting through the first air line nozzles 4 the aforementioned highly turbulent toroidal eddy. This type of injection of the combustion air through the balanced combination of the air line nozzles 4 and the air line nozzles 5 ensures very even distribution across the cross-section of the combustion zone, which contributes towards even temperature distribution. The main injection of air occurs through the first air line nozzles 4.

The air line nozzles 4 and 5 are arranged in such a manner that a first air line nozzle 4 is located upstream of each second air line nozzle 5. The second air line nozzles 5 extending into the combustion zone are therefore reliably cooled by the combustion air exiting through the appertaining first air line nozzles 4.

Another feature which contributes towards eddy formation or mixture formation and towards a homogeneous mixture and therefore a reduction in the temperature and even temperature distribution is that the cross-section of the first air line nozzles 4—in contrast to the cylindrical cross-section of the second air line nozzles 5—is elongated in the direction of the fire tube axis so that the air inlet stretches over a certain axial length. Two guide plates 8 in the first air line nozzles 4 help to guide the combustion air in a controlled manner into the fire tube 3.

For favourable flow control, the respective outlet opening of the second air line nozzles 5 of the second row 7 are in a plane perpendicular to the axis of the appertaining air line nozzle.

As shown in FIG. 1, the fire tube cover 1 forms on the inside a conical extension from the fuel nozzle 2 to the fire tube 3. This design of the fire tube cover area helps to stabilise the eddy flow. The gas is blown into the eddy flow at an inclined angle outwards. For this purpose, the fuel nozzle exhibits outlet openings 9 which are inclined in the direction of flow away from the axis of the fire tube 3.

Figure 3:
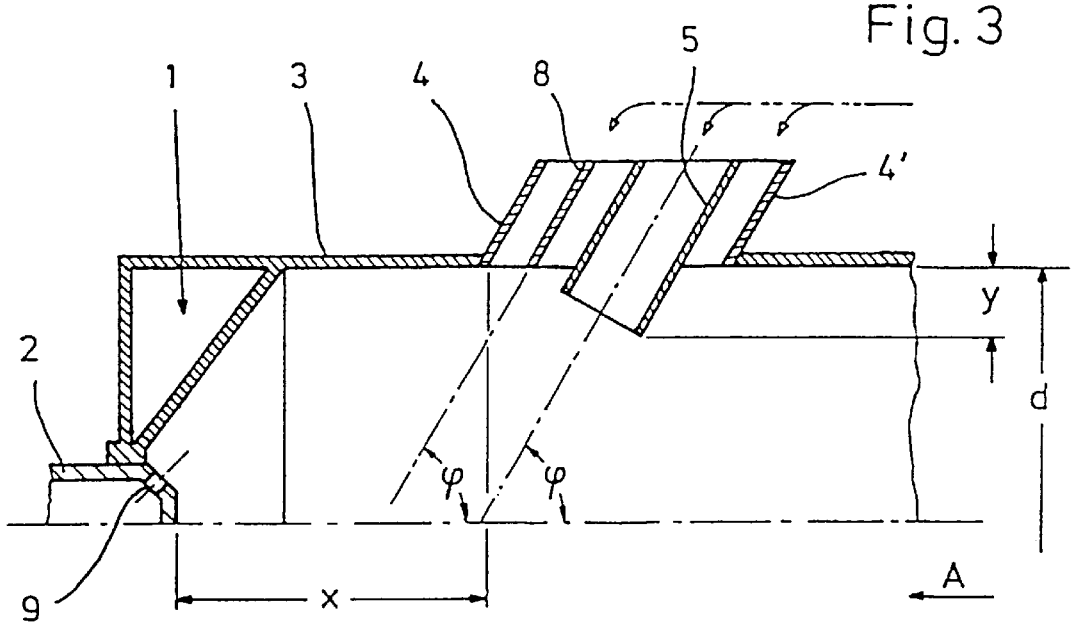
FIG. 3 a schematic of an axial partial section through a burner according to a second embodiment.
Figure 4:
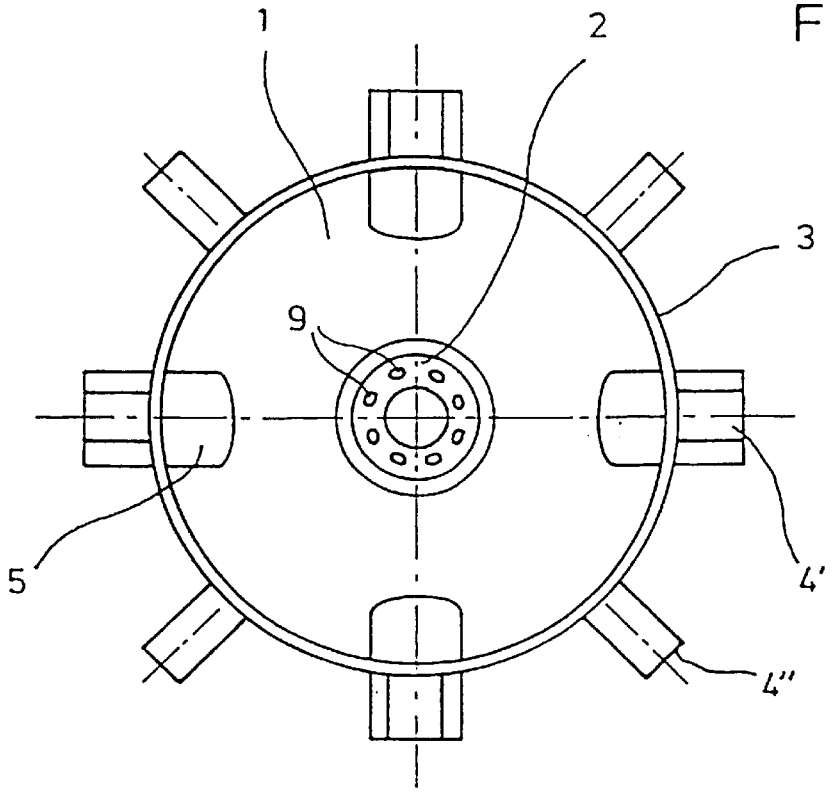
FIG. 4 a view in the direction of arrow A in FIG. 3.

FIGS. 3 and 4 are a particularly advantageous embodiment of the burner which is mainly distinguished from the embodiment according to FIGS. 1 and 2 in that third air line nozzles 4' are arranged downstream of the second air line nozzles 5. The third air line nozzles 4' therefore provide a stream of air which extends along the downstream side of the appertaining air line nozzle 5. This reinforces the cooling effect and furthermore supports the formation of the highly turbulent toroidal eddy.

A common feature of both embodiments is that, as can be seen from FIGS. 2 and 4, fourth air line nozzles 4" are provided. These are located, viewed in the axial direction, between neighbouring second air line nozzles 5. In the embodiment according to FIGS. 1 and 2 they are located on the same level as the first air line nozzles 4. In the embodiment according to FIGS. 3 and 4 they are flush, viewed in the circumferential direction, with the first and second air line nozzles 4 and 4'. Furthermore, they correspond in their angle of incline and arrangement to the first and third air line nozzles.

If the two types of air line nozzles are examined, it can be seen that there are fewer second air line nozzles than the other air line nozzles. This also applies to the cross-section ratio. For example, the total cross-section of the second air line nozzles 5 is 0.6 times to 0.7 times the total cross-section of the first and fourth air line nozzles 4, 4" (FIGS. 1 and 2) and the total cross-section of the first, third and fourth air line nozzles 4, 4', 4" (FIGS. 3 and 4).

Furthermore, the fire tube 3 exhibits in both examples further openings for combustion air downstream of the air line nozzles in order to reduce $CO_2$ formation. Also not shown in the drawing are openings in the fire tube cover 1 and in the upstream area of the fire tube 3, the combustion air entering at these points mainly being used for cooling the fire tube cover and the fire tube.

Modifications are possible under this invention. For example, the air line nozzles can be inclined at different angles. Furthermore, it is possible to feed the fuel axially into the fire tube. In the present embodiment the combustion air is primarily fed in through the two types of air line nozzles. It is alternatively possible to feed in some of the air downstream instead of upstream.

The invention has been described with the aid of a gas burner which is its preferred field of application. However, it can also be used with burners for vaporous, liquid or fluid solid fuels.

What is claimed is:

1. A Burner for fuels suitable for spraying, in particular gaseous fuels, having a substantially cylindrical fire tube (3), a fire tube cover (1) arranged on the upstream end of the fire tube (3)

a fuel nozzle (2) terminating centrally in the fire tube cover (1) and a plurality of first and second means to feed combustion air into the fire tube, wherein, means for feeding combustion air into the fire tube (3) are air line nozzles (4 and 5), the first and second air line nozzles (4 and 5) are inclined in the direction of counterflow to the axis of the fire tube (3), the first air line nozzles (4) terminate at the fire tube (3) whilst the second air line nozzles (5) extend into the fire tube, a first air line nozzle (4) is assigned to each second air line nozzle (5) and arranged upstream directly adjacent thereto, and a third air line nozzle (4') is assigned to each second air line nozzle (5) and arranged downstream directly adjacent thereto, the third air line nozzles (4') being inclined in the direction of counterflow to the axis of the fire tube (3) and terminating at the fire tube.

2. The Burner according to claim 1 wherein, viewed in the axial direction, a fourth air line nozzle (4") is arranged between each two adjacent second air line nozzles (5), the fourth air line nozzles (4") being inclined in the direction of counterflow to the axis of the fire tube (3) and terminating at the fire tube.

3. The Burner according to claim 1 wherein the first air line nozzles (4) are arranged in a first axis-vertical row (6) and that the axial distance (x) between the fuel nozzle (2) and the openings of the first air line nozzles (4) is approx. 0.70 times to 0.85 times the fire tube diameter (d).

4. The Burner according to claim 1 wherein the air line nozzles are inclined by the same angle (ϕ) to the axis of the fire tube (3).

5. The Burner according to claim 3 or 4 wherein the air line nozzles (4, 5, 4, 4") are inclined by approx. 55 to 60° to the axis of the fire tube (3).

6. The Burner according to claim 1 wherein the openings of the second air line nozzles (5) extending into the fire tube (3) are at a distance (y) to the fire tube (3) which is approx. 0.15 times to 0.18 times the fire tube diameter (d).

7. The Burner according to claim 1 wherein the total cross-section of the second air line nozzles (5) is approx. 0.6 times to 0.7 times the total cross-section of the first and third air line nozzles.

8. The Burner according to claim 1 wherein the first and the third air line nozzles exhibit different cross-sections, of which at least some are elongated in the direction of the axis of the fire tube (3).

9. The Burner according to claim 8 wherein the first air line nozzles each contain a maximum of two guide plates (8) which are preferably transverse to the axis of the fire tube (3).

10. The Burner according claim 1 wherein the relevant outlet opening of the second air line nozzles (5) is located in a plane perpendicular to the axis of the relevant air line nozzle (5).

11. The Burner according to claim 1 wherein the fire tube cover (1) is flared inside, starting from the fuel nozzle (2), towards the fire tube (3).

12. The Burner according to claim 1 wherein the fuel nozzle (2) exhibits a ring of outlet openings (9) which are inclined in the direction of flow away from the axis of the fire tube (3).

13. The Burner according to claim 12 wherein the angle of incline of the outlet openings (9) of the fuel nozzle (2) to the axis of the fire tube (3) is 40–45°.

14. The Burner according to claim 1 wherein the fire tube (3) is provided downstream of the air line nozzles with several circularly arranged openings for combustion air.

15. The Burner according to claim 2, wherein the air line nozzles are inclined by the same angle (ϕ) to the axis of the fire tube (3).

16. The Burner according to claim 2, wherein the total cross-section of the second air line nozzles (5) is approx. 0.6 times to 0.7 times the total cross-section of the first and third and the fourth air line nozzles.

17. The Burner according to claim 2, wherein the first and the third and the fourth air line nozzles exhibit different cross-sections, of which at least some are elongated in the direction of the axis of the fire tube (3).

18. The Burner according to claim 17, wherein the first and the third and the fourth air line nozzles exhibit different cross-sections, of which at least some are elongated in the direction of the axis of the fire tube (3).

* * * * *